US005094627A

United States Patent [19]

Uekido

[11] Patent Number: 5,094,627

[45] Date of Patent: Mar. 10, 1992

[54] PRINTED CIRCUIT BOARD MOUNTED CONNECTOR

[75] Inventor: Kouzou Uekido, Tokyo, Japan

[73] Assignee: NEC Corporation, Tokyo, Japan

[21] Appl. No.: 563,060

[22] Filed: Aug. 6, 1990

[30] Foreign Application Priority Data

Aug. 7, 1989 [JP] Japan ..... 1-92135[U]

[51] Int. Cl.[5] ..... H01R 9/03

[52] U.S. Cl. ..... 439/610; 439/79

[58] Field of Search ..... 439/607-610, 439/578-585, 675, 92, 95, 96, 101, 108

[56] References Cited

U.S. PATENT DOCUMENTS

| | | | |
|---|---|---|---|
| 4,611,878 | 9/1986 | Hall et al. | 439/610 |
| 4,637,669 | 1/1987 | Tajima | 439/609 |
| 4,738,637 | 4/1988 | Asick et al. | 439/610 |
| 4,908,335 | 3/1990 | Cosmos et al. | 439/609 |
| 4,938,714 | 7/1990 | Kawai et al. | 439/609 |

FOREIGN PATENT DOCUMENTS

| | | | |
|---|---|---|---|
| 2184899 | 7/1987 | United Kingdom | 439/607 |

*Primary Examiner*—David L. Pirlot

*Attorney, Agent, or Firm*—Burns, Doane, Swecker & Mathis

[57] ABSTRACT

A printed circuit board mounted connector includes an insulating body and a shield plate. The insulating body incorporating contact terminals and adapted to be mounted on a printed circuit board. The shield plate covers a front surface and both side surfaces of the insulating body. The shield plate has bent portions which are formed by partially cutting and bending a shield plate portion corresponding to the front surface of the insulating body and extend toward the insulating body to define a substantially circular opening for receiving annular shield contact terminals of a mating connector, and shield springs which are formed by partially cutting and bending shield plate portions corresponding to both the side walls of the insulating body and extend away from the insulating body. The shield springs are brought into contact with a ground plate extending in a direction perpendicular to a surface of the printed circuit board.

3 Claims, 5 Drawing Sheets

PRINTED CIRCUIT BOARD MOUNTED CONNECTOR

BACKGROUND OF THE INVENTION

The present invention relates to a printed circuit board mounted connector used to connect electronic devices such as personal computers through cables and, more particularly, to a shield structure of the connector.

A typical conventional printed circuit board mounted connector (to be referred to as a socket connector hereinafter) of this type is disclosed in Japanese Utility Model Laid-Open No. 61-201284. This socket connector will be described with reference to FIGS. 4A to 8.

FIGS. 4A and 4B show the conventional socket connector, FIG. 5 shows an annular shield used in this socket connector, FIG. 6 shows a shield plate used in the socket connector, FIG. 7 shows a state of use of the socket connector, and FIG. 8 shows a plug cable connected to the conventional socket connector. Referring to FIGS. 4A to 8, reference numeral 1 denotes a conventional socket connector. The socket connector 1 comprises an insulating body 3 incorporating female terminals 2, and an annular shield 4 and a shield plate 5, latter two of which are mounted on the insulating body 3. The female terminals 2 are respectively inserted and fixed in female terminal accommodating holes 3*a* formed in the insulating body 3. One end of each female terminal 2 extends below the insulating body 3. An annular recessed groove 3*b* open to the front surface is formed at the connecting port of the insulating body 3. The annular shield 4 is mounted in the annular recessed groove 3*b*. The annular shield 4 consists of a conductive material and has almost a cylindrical shape as a whole, as shown in FIG. 5. A one-end portion of the annular shield 4 at a position corresponding to the connecting port is tapered so that the diameter is increased toward the distal end. A shield terminal 4*a* is formed integrally with the other-end portion of the annular shield 4 to extend below the insulating body 3. The shield plate 5 consists of a conductive material. As shown in FIG. 6, the shield plate 6 has an inverted-U shaped member which covers both side surfaces and the upper surface of the insulating body 3. A flange 5*b* connected to a shield panel (to be described later) and having a screw hole 5*a* is formed integrally with the shield plate 5 at a position corresponding to the upper surface of the insulating body 3. Shield terminals 5*c* are formed integrally with lower end portions of the shield plate 5 at positions corresponding to the side surfaces of the insulating body 3. The shield terminals 5*c* extend below the insulating body 3. Reference numeral 6 denotes a printed circuit board on which electronic components (not shown) are to be mounted. The extended end portions of the female terminals 2 and the shield terminals 4*a* and 5*c* of the socket connector 1 are connected to the printed circuit board, so that the socket connector 1 is mounted on the printed circuit board 6. The printed circuit board 6 is arranged so that the shield terminal 4*a* of the annular shield 4 is electrically connected to the shield terminals 5*c* of the shield plate 5 through the printed circuit board 6. More specifically, when the socket connector 1 is mounted on the printed circuit board 6, the annular shield 4 and the shield plate 5 are electrically connected through the printed circuit board 6. Reference numeral 7 denotes a shield panel serving as a ground plate constituting the frame of the electronic device. The shield panel 7 stands upright on the printed circuit board 6 at its connecting port which connects the socket connector 1. A plug cable insertion opening 7*a* (to be described in detail later) is formed in the socket connector 1 at a position corresponding to the connecting port. Reference numeral 8 denotes a plug cable connected to the socket connector 1. Male terminals 8*a* to be connected to the female terminals 2 of the socket connector 1, and an annular shield 8*b* which shields a cable (not shown) and is connected to the annular shield 4 of the socket connector 1 are formed at the fitting portion of the plug cable 8, as shown in FIG. 8. It should be noted that the annular shield 8*b* has a size enough to fit the annular shield 8*b* into the opening of the annular shield 4.

In order to mount the conventional socket connector having the above structure, the socket connector 1 is mounted on the printed circuit board 6, and the flange 5*b* of the shield plate 5 is fixed by a screw 9 to the shield panel serving as the frame of the electronic device. At this time, the shield plate 5 of the socket connector 1 is electrically connected to the shield panel 7.

In order to connect the plug cable 8 to the socket connector 1 attached to the electronic device described above, the annular shield 8*b* of the plug cable 8 is inserted into the opening 7*a* of the shield panel 7 and then the annular recessed groove 3*b* of the insulating body 3. When the annular shield 8*b* is fitted in the annular recessed groove 3*b* of the insulating body 3, this annular shield 8*b* is brought into contact with the annular shield 4 of the socket connector 1 and is electrically connected thereto. At the same time, the male terminals 8*a* are connected to the corresponding female terminals 2.

When the plug cable 8 is connected to the socket connector 1 as described above, the annular shield 8*b* of the plug cable 8 is connected to the shield panel 7 through the annular shield 4 of the socket connector 1, the printed circuit board 6, and the shield plate 5 of the socket connector 1 in the order named, thereby providing a shield implementation of the plug cable 8.

In the conventional socket connector 1 having the above structure, when the shield of the plug cable 8 is to be connected to the shield of the electronic device, the shield of the plug cable 8 is short-circuited to the shield plate 5 of the socket connector 1 through the annular shield 4 of the socket connector 1 and the printed circuit board 6 and is connected to the shield panel 7 through the flange 5*a* of the shield plate 5 and its screw portion. In this manner, the shield of the plug cable is connected through a lot of connecting points. For this reason, shield impedances vary, and a stable shield effect cannot be obtained.

SUMMARY OF THE INVENTION

It is an object of the present invention to provide a socket connector in which variations in shield impedances can be minimized and a stable shield effect can be obtained and threaded inserts are not required with the result of minimizing the steps of assembly.

In order to achieve the above object of the present invention, there is provided a printed circuit board mounted connector comprising an insulating body incorporating contact terminals and adapted to be mounted on a printed circuit board, and a shield plate for covering a front surface and both side surfaces of the insulating body, the shield plate being provided with bent portions which are formed by partially cutting and bending a shield plate portion corresponding to the front surface of the insulating body and extend toward the insulating body to define a substantially circular opening for receiving annular shield contact terminals of a mating connector, and shield springs which are formed by partially cutting and bending shield plate portions corresponding to both the side walls of the insulating body and extend away from the insulating body, the shield springs being brought into contact with a ground plate extending in a direction perpendicular to a surface of the printed circuit board.

According to the present invention, when a mating connector is connected to the printed circuit board mounted connector, the shield annular contact of the mating connector is connected to the shield plate and is connected to the ground plate through a contact piece of this shield plate, and the shield annular contact, thereby shortening a total connecting path and requiring no threaded inserts to retain the shield plate to the panel.

DESCRIPTION OF THE PREFERRED EMBODIMENT

An embodiment of the present invention will be described in detail with reference to FIG. 1A to 3.

Figure 1A:
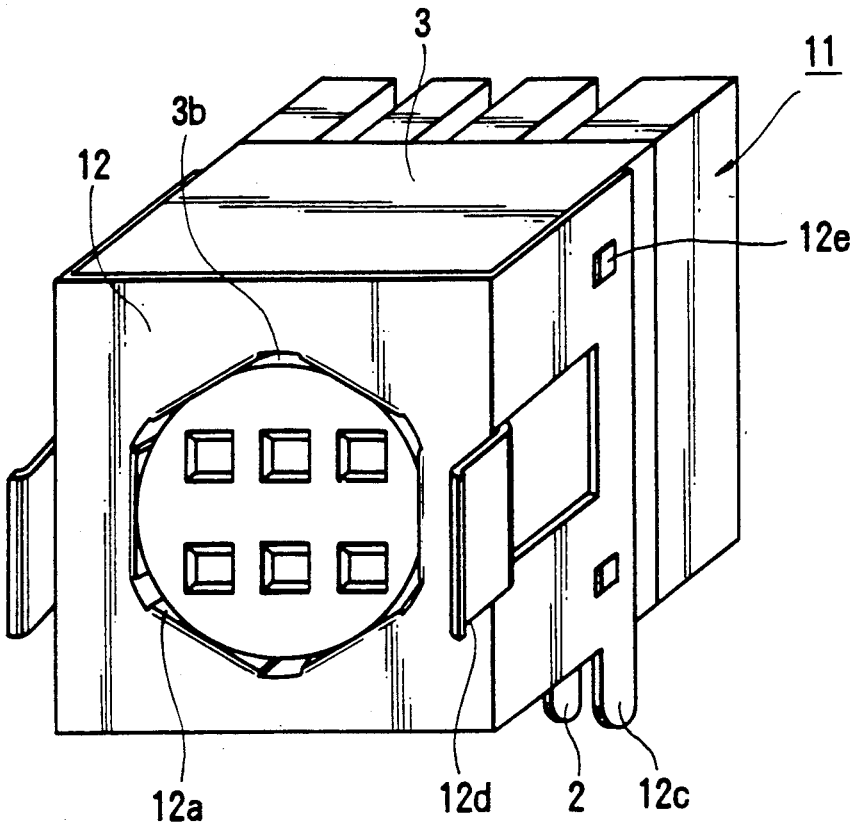
FIG. 1A is a perspective view of a socket connector according to an embodiment of the present invention.
Figure 1B:
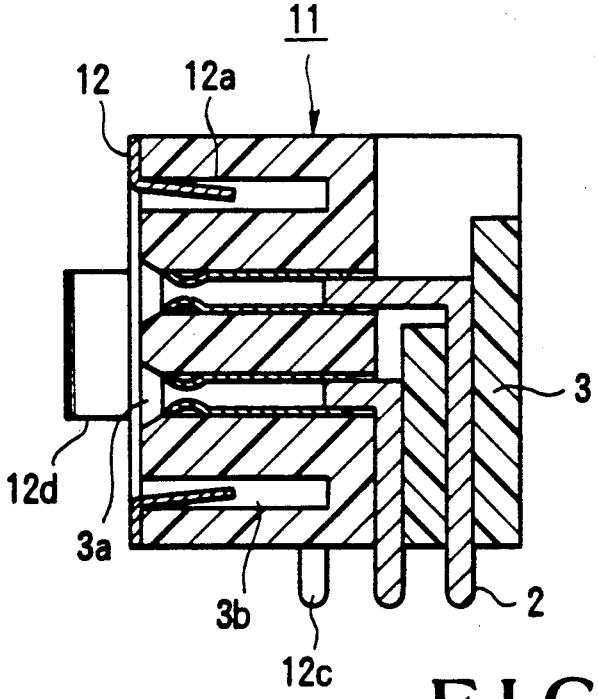
FIG. 1B is a longitudinal sectional view of the socket connector shown in FIG. 1A.
Figure 2A:
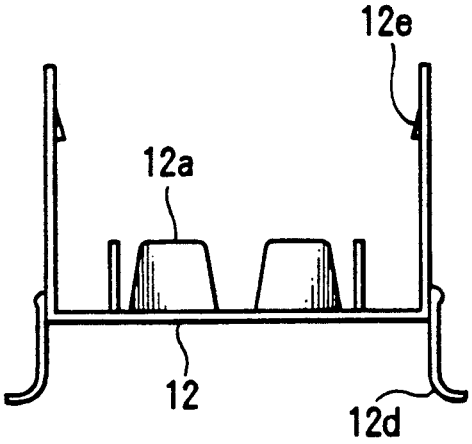
FIG. 2A is a plan view of a shield plate used in the socket connector of the present invention.
Figure 2B:
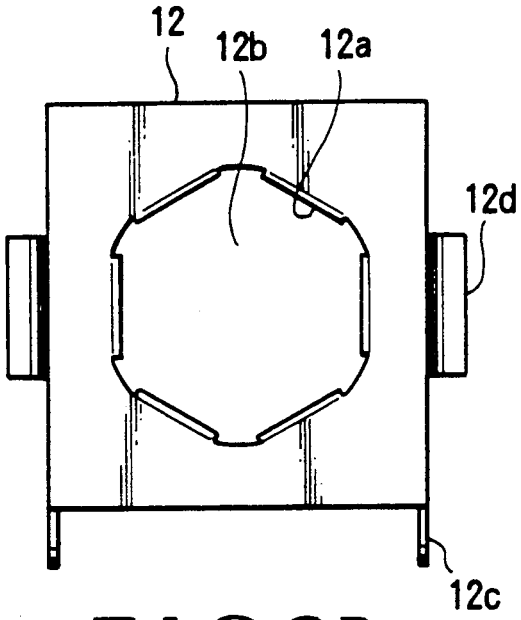
FIG. 2B is a front view of the shield plate shown in FIG. 2A.
Figure 2C:
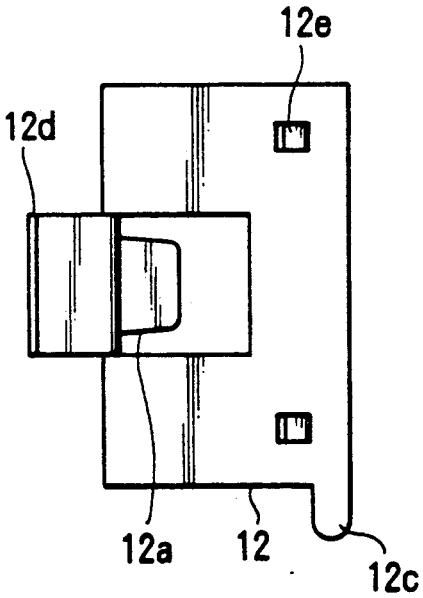
FIG. 2C is a side view of the shield plate shown in FIG. 2A.
Figure 2D:
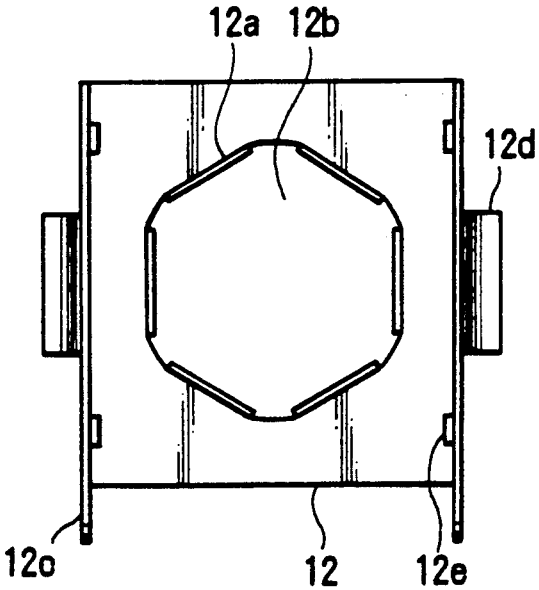
FIG. 2D is a rear view of the shield plate shown in FIG. 2A.
Figure 3:
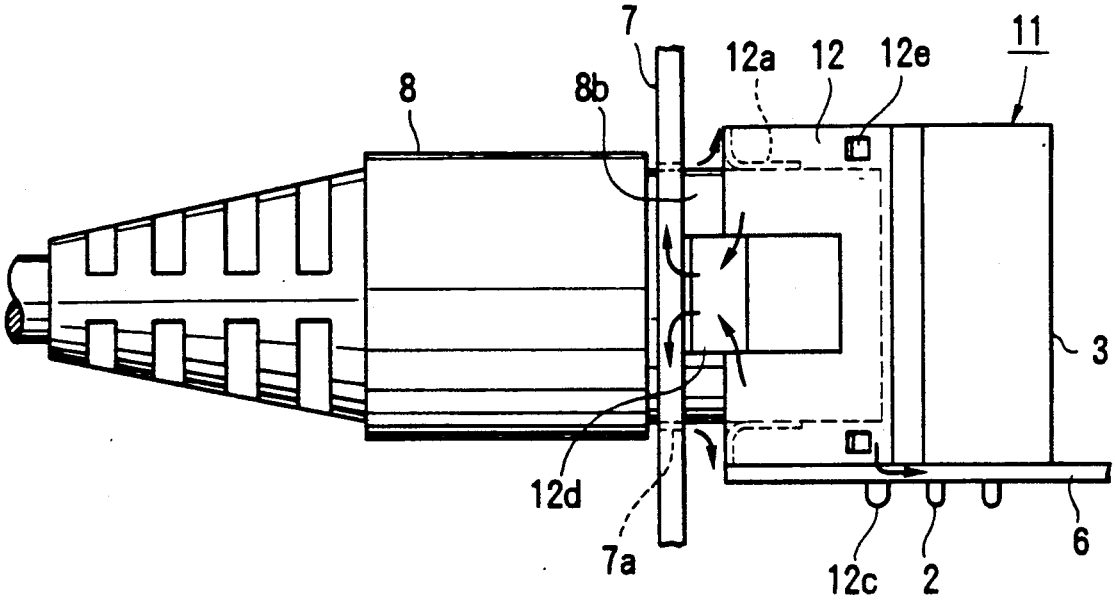
FIG. 3 is a side view showing a state of use of the socket connector according to the present invention.
Figure 4A:
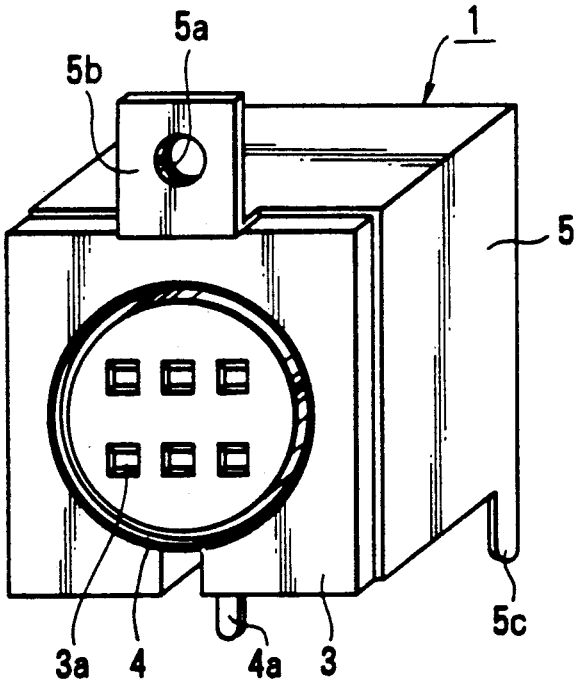
FIG.4A PRIOR ART
FIG. 4A is a perspective view of a conventional socket connector.
Figure 4B:
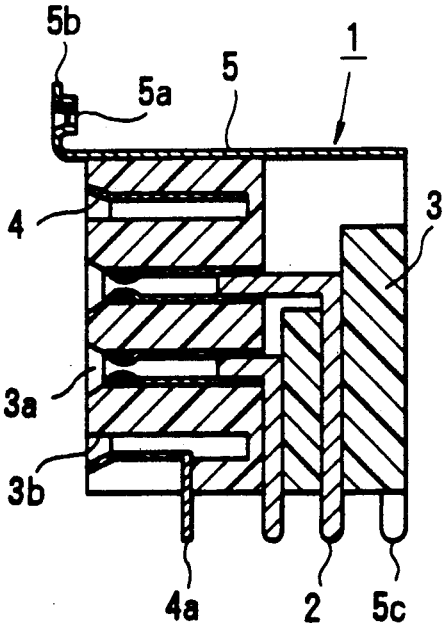
FIG.4B PRIOR ART
FIG. 4B is a longitudinal sectional view of the conventional socket connector shown in FIG. 4A.
Figure 5:
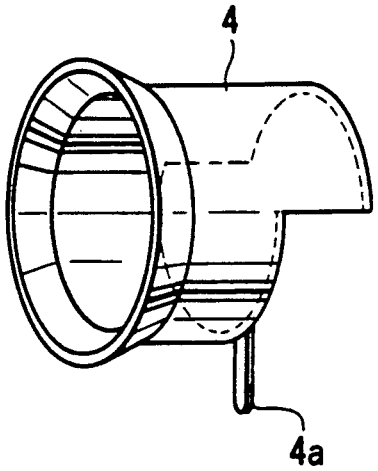
FIG.5 PRIOR ART
FIG. 5 is a perspective view of an annular shield used in the conventional socket connector.
Figure 6:
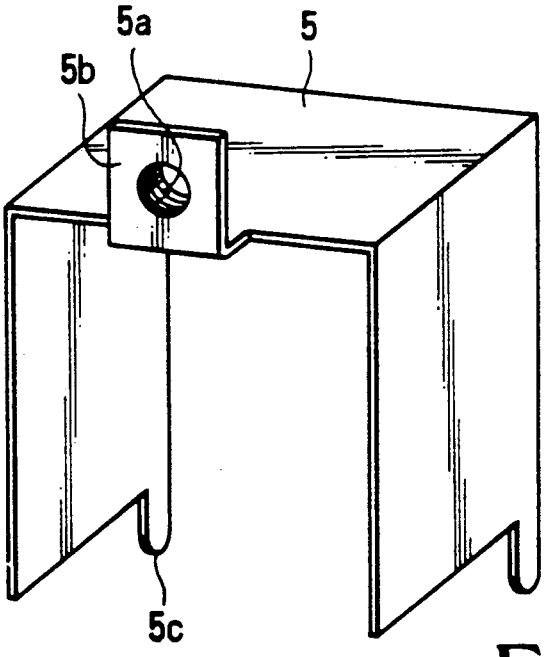
FIG.6 PRIOR ART
FIG. 6 is a perspective view of a shield plate used in the conventional socket connector.
Figure 7:
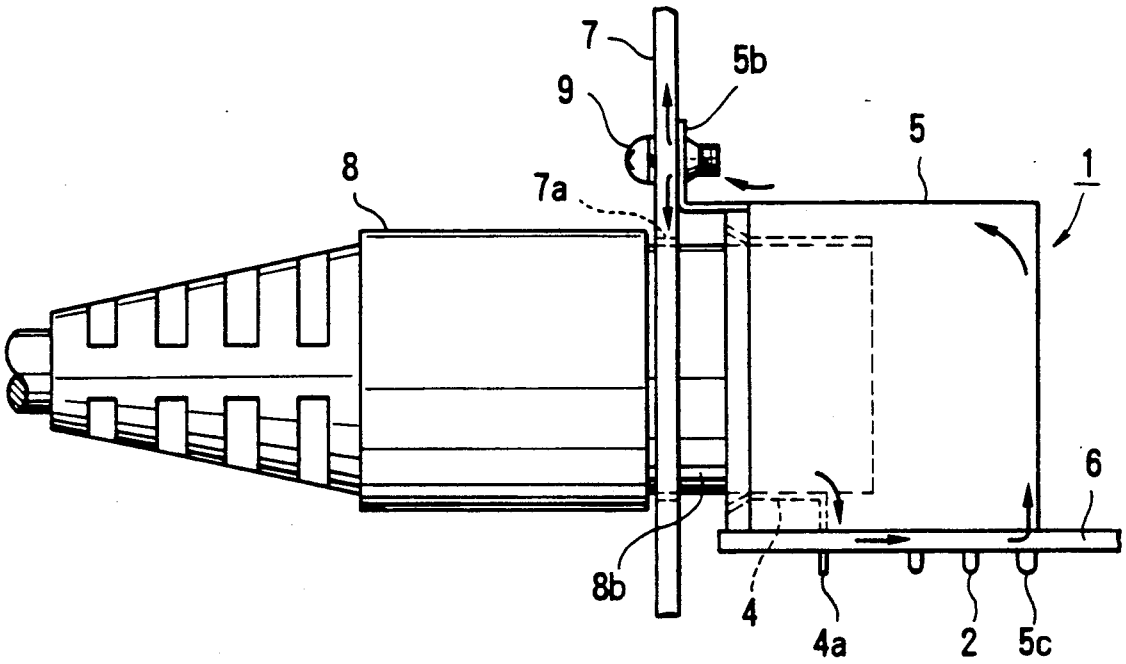
FIG.7 PRIOR ART
FIG. 7 is a side view showing a state of use of the conventional socket connector.
Figure 8:
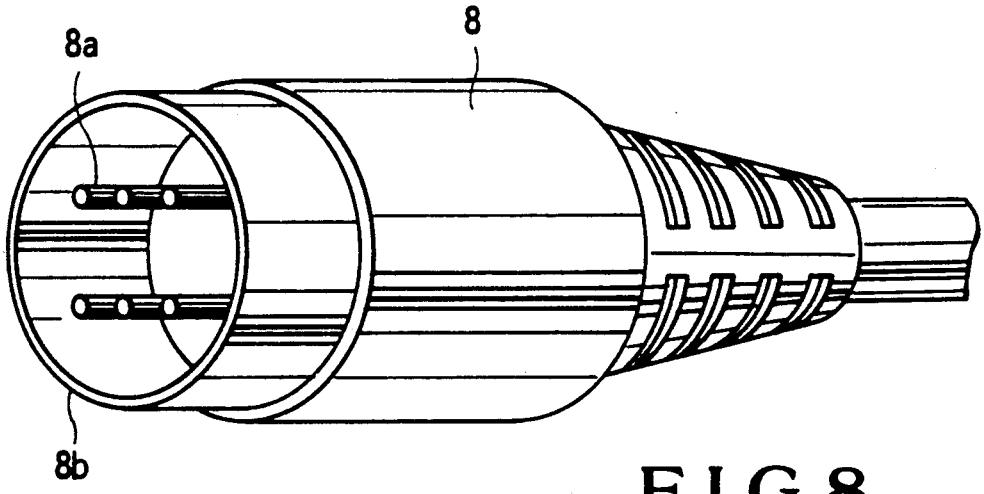
FIG.8 PRIOR ART
FIG. 8 is a perspective view showing a plug cable connected to the conventional socket connector.

FIGS. 1A and 1B show a socket connector according to an embodiment of the present invention, FIGS. 2A to 2D show a shield plate used in the socket connector of this embodiment, and FIG. 3 shows a state of use of this socket connector. The same reference numerals as in FIGS. 4A to 8 denote the same parts in FIGS. 1A to 3, and a detailed description thereof will be omitted.

Referring to FIGS. 1A to 3, reference numeral 11 denotes a socket connector according to an embodiment of the present invention. The socket connector 11 comprises an insulating body 3 incorporating female terminals 2, and a shield plate 12 mounted on the insulating body 3 from the front side of the insulating body 3. The shield plate 12 comprises almost an inverted-V shaped conductive member to cover the front surface and both side surfaces of the insulating body 3. A plurality of inward bent portions 12*a* are formed at a portion of the shield plate 12, which portion corresponds to an annular recessed groove 3*b* of the insulating body 3. The plurality of inward bent portions 12*a* form a substantially circular shape, thereby defining an almost circular opening 12*b* in the shield plate 12. The bending angles of the inward bent portions 12*a* are set so that the opening 12*b* is gradually narrowed toward the insulating body 3. More specifically, when the plug cable 8 is to be connected to the socket connector 11, the annular shield 8*b* of the plug cable 8 is urged against the inward bent portions 12*a* and is fitted into the opening 12*b*. Shield terminals 12*c* extend from lower end portions of the shield plate 12 at positions corresponding to the side surfaces of the insulating body 3, so that the shield terminals 12*c* can be connected to the printed circuit board 6. At the same time, side surface portions of the shield plate 12 are partially cut in a rectangular shape and bent toward the connecting port of the socket connector 11, thereby forming shield springs 12*d*. The distal end portions of the shield springs 12*d* are bent outward in the direction of width of the insulating body 3, thereby providing a spring function in the back-and-forth direction of the socket connector 11. In addition to the shield springs 12*d*, portions of the shield plate which correspond to the side surfaces of the insulating body are partially cut and bent inward, i.e., toward the insulating body, thereby forming mounting lock pieces 12*e*.

The socket connector 11 having the above structure according to the present invention is assembled so that the plate 12 is mounted on the insulating body 3 from its front side. During assembly, the inward bent portions 12*a* of the shield plate 12 are inserted into the annular recessed groove 3*b* of the insulating body 3, and the mounting lock pieces 12*e* are locked on the side portions of the insulating body 3. When this socket connector 11 is to be attached to an electronic device, the socket connector 11 is mounted on the printed circuit board 6, as shown in FIG. 3. In this case, the extended end portions of the female terminals 2 are connected to a wiring pattern (not shown) on the printed circuit board 6, and the shield terminals 12*c* of the shield plate 12 are connected to a shield pattern (not shown) of the printed circuit board 6. Thereafter, the printed circuit board 6 is fixed to the electronic device while the distal ends of the shield springs 12*d* of the shield plate 12 are kept urged against the shield plate 7, thereby completing mounting of the socket connector 11.

In order to connect the plug cable 8 to the socket connector 11 mounted in the electronic device, the annular shield 8*b* of the plug cable 8 is inserted into the opening 7*a* of the shield panel 7 and then the annular recessed groove 3*b* of the insulating body 3. When the annular shield 8*b* is fitted into the annular recessed groove 3*b* of the insulating body 3, the annular shield 8*b* is brought into contact with the inward bent portions 12*a* of the shield plate 12 and is electrically connected thereto. At the same time, the male terminals 8*a* are connected to the corresponding female terminals 2.

When the plug cable 8 is connected to the socket connector 11, as described above, the annular shield 8*b* of the plug cable 8 is short-circuited to the shield panel 7 through the inward bent portions 12*a* and the shield springs 12*d* of the shield plate 12. Therefore, an excellent shield implementation for the plug cable 8 can be provided.

Since the annular shield 8*b* of the plug cable 8 is connected to the shield panel 7 through only the shield plate 12, a connecting path can be shortened.

As illustrated in the above embodiment, when the shield terminal 12*c* of the shield plate 12 is connected to the shield pattern of the printed circuit board 6, a higher shield effect can be obtained.

The printed circuit board mounted connector of the present invention, as has been described above, comprises a connector body (insulating body) incorporating contact terminals (female terminals) and adapted to be mounted on the printed circuit board, and the shield plate for covering the front surface and both side surfaces of the insulating body. A shield plate portion corresponding to the front surface of the insulating body is partially cut and bent to form the inward bent portions extending toward the insulating body. Shield plate portions corresponding to the both side surfaces of the insulating body are partially cut and bent to form shield springs extending away from the insulating body. The shield springs are brought into contact with the ground plate extending in a direction perpendicular to the surface of the printed circuit board. When the mating connector is connected to the printed circuit board mounted connector of the present invention, the annular shield contact terminals of the mating connector are connected to the shield plate and are connected to the ground plate through the contact pieces of this shield plate. Therefore, the annular shield contact terminals of the mating connector are connected to the ground plate through only the shield plate. Therefore, the connecting path can be shortened, variations in shield impedances can be minimized, and a stable shield effect can be obtained.

What is claimed is:

1. A printed circuit board mounted connector comprising:

an insulating body incorporating contact terminals and adapted to be mounted on a printed circuit board; and a shield plate for covering a front surface and two side surfaces of said insulating body, said shield plate being provided with bent portions which are formed by partially cutting and bending a shield plate portion corresponding to said front surface of said insulating body and extend toward said insulating body to define a substantially circular opening for receiving annular shield contact terminals of a mating connector, and shield springs which are formed by partially cutting and bending shield plate portions corresponding to said two side walls of said insulating body and extend away from said insulating body, said shield springs being brought into contact with a ground plate extending in a direction perpendicular to a surface of said printed circuit board.

2. A connector according to claim 1, wherein said bent portions have bending angles set so that said substantially circular opening is narrowed toward said insulating body.

3. A connector according to claim 2, further comprising mounting lock pieces extending from shield plate portions corresponding to said two side walls of said insulating body toward said insulating body so as to lock said insulating body.

* * * * *